US005851371A

United States Patent [19]

Steinbrecher et al.

[11] Patent Number: 5,851,371

[45] Date of Patent: Dec. 22, 1998

[54] REDUCING OR AVOIDING SURFACE IRREGULARITIES IN ELECTROPHORETIC PAINTING OF PHOSPHATED METAL SURFACES

[75] Inventors: Lester E. Steinbrecher, North Wales, Pa.; Timothy J. Zens, Grosse Pointe Park, Mich.

[73] Assignee: Henkel Corporation, Plymouth Meeting, Pa.

[21] Appl. No.: 874,238

[22] Filed: Jun. 16, 1997

Related U.S. Application Data

[63] Continuation of Ser. No. 642,619, May 3, 1996, abandoned, which is a continuation of Ser. No. 396,396, Feb. 28, 1995, abandoned.

[51] Int. Cl.[6] ..... C25D 13/12

[52] U.S. Cl. ..... 204/486; 148/256; 148/257

[58] Field of Search ..... 204/484, 486; 148/256, 257

[56] References Cited

U.S. PATENT DOCUMENTS

| | | | |
|---|---|---|---|
| 3,185,596 | 5/1965 | Schiffman | 148/6.16 |
| 3,607,453 | 9/1971 | Engesser et al. | 148/262 |
| 3,912,548 | 10/1975 | Faigen | 148/6.15 R |
| 3,966,502 | 6/1976 | Binns | 148/6 |
| 4,165,242 | 8/1979 | Kelly et al. | 204/181.1 |
| 4,191,596 | 3/1980 | Dollman et al. | 148/6.27 |
| 4,376,000 | 3/1983 | Lindert | 148/6.15 |
| 4,433,015 | 2/1984 | Lindert | 427/388.4 |
| 4,457,790 | 7/1984 | Lindert et al. | 148/6.15 |
| 4,517,028 | 5/1985 | Lindert | 148/6.14 |
| 4,963,596 | 10/1990 | Lindert et al. | 526/313 |
| 5,063,089 | 11/1991 | Lindert et al. | 427/354 |
| 5,116,912 | 5/1992 | Lindert et al. | 525/340 |
| 5,298,289 | 3/1994 | Lindert et al. | 427/388.4 |

FOREIGN PATENT DOCUMENTS 9311627 11/1993 WIPO .

*Primary Examiner*—Kathryn L. Gorgos
*Assistant Examiner*—Kishor Mayekar
*Attorney, Agent, or Firm*—Wayne C. Jaeschke; Norvell E. Wisdom, Jr.; Wayne C. Jaeschke, Jr.

[57] ABSTRACT

The phenomenon of "mapping" (surface defects) after electrophoretic painting over phosphate conversion coatings passivated with hexavalent chromium containing passivating compositions can be avoided or reduced by keeping the surface being treated constantly wet from the time it is conversion coated until it is electrophoretically painted, by preceding the passivating step by treatment with an aqueous liquid treatment composition comprising at least one of the following components: (A) a water soluble and/or water dispersible polymer with a weight average molecular weight of at least 500; (B) fluorometallic acids and anions thereof, the molecules of which consist of (i) at least one atom of boron, silicon, zirconium, iron, aluminum, or titanium, (ii) at least four fluorine atoms, and, optionally, (iii) one or more atoms of oxygen, hydrogen, or both; (C) zirconium salts of ethylenediamine tetraacetic acid; and (D) alkali metal and ammonium zirconyl carboxylates and carbonates; or by replacing the chromium containing passivating composition with an aqueous liquid treatment composition of the same type as described above.

20 Claims, No Drawings

REDUCING OR AVOIDING SURFACE IRREGULARITIES IN ELECTROPHORETIC PAINTING OF PHOSPHATED METAL SURFACES

This is a continuation of application Ser. No. 08/642,619 filed May 3, 1996 which is a continuation of application Ser. No. 08/396,396 filed Feb. 28, 1995, both abandoned.

BACKGROUND OF THE INVENTION

1. Field of the Invention

This invention relates to processes for forming a protective coating on metal, particularly ferrous and/or zinciferous metal, surfaces by applying to the metal surfaces in order (i) a phosphate conversion coating and (ii) a cathodically or anodically deposited electrophoretic paint protective outer coating including an organic binder. More particularly, this invention is related to avoiding or at least reducing undesirable surface texture after completion of such a process, where the metal surface to be treated is maintained continuously wet between the steps of phosphating and electrophoretically painting, with an aqueous liquid treatment composition.

2. Discussion of Related Art

The general type of process described above is well known and commercially very important, particularly in the automobile and related vehicle industry, in which many millions of square meters of steel and galvanized steel surfaces are protected against corrosion and provided with an aesthetically appealing surface finish by such processes every year in the U.S. alone. Most often, these processes include, as a preferred optional step (i') between steps (i) and (ii) described above, contacting the conversion coating formed in step (i) with an aqueous liquid composition variously known as a sealer, "final rinse", or passivating composition. The most used such processes at present, when excellent corrosion protection is desired, are believed to be (i) phosphating with a zinc containing aqueous liquid phosphating composition, preferably one that also includes manganese and, more preferably, also at least one of nickel, copper, and silver in sufficient quantities that the manganese and a third type of cations distinct from manganese and zinc, if cations of such a third type are present in the phosphating composition, are incorporated into the phosphate conversion coating layer formed in readily detectable amounts; (i') passivating by contact with a composition containing a total of at least 0.05% of trivalent and hexavalent chromium (the latter being alternatively known as "chromate"), preferably containing both trivalent and hexavalent chromium; and (ii) painting with a cathodic electrophoretically applied paint (this process and the coating applied therein being usually hereinafter denoted simply as "cathodic painting" and "cathodic paint" for brevity).

Ordinarily, such a process produces highly satisfactory results, but it is known in the art that such a process is susceptible occasionally, for reasons not yet understood, to a serious aesthetic defect: the presence in the final coated surface of small scale surface irregularities that do not correspond to any irregularities in the underlying metal surface. The occurrence of defects of this type is variously known as "mapping", which is believed to be the most general term in common use in the art and will be used hereinafter to include all the terms for this effect noted below; "orange peel", when the defect is generalized small scale surface roughness analogous to that on an orange; "Naugahyde™", when the surface texture is qualitatively like orange peel but quantitatively more pronounced; and "patterning" when the irregularities occur only on some relatively small part of the total surface. Although mapping can occur with any kind of paint, experience has indicated that cathodically electrodeposited paint, which in most other respects is superior in quality to most if not all practical alternatives known at present for corrosion resistant decorative finishes such as those used for autobodies and the like, is even more susceptible to mapping, when applied over sealed phosphate conversion coatings, than other types of paint or similar protective coatings.

DESCRIPTION OF THE INVENTION

Objects of the Invention

One major object of the invention is to avoid or at least reduce mapping while retaining the other benefits known in the art for electrophoretic painting over phosphate conversion coatings, which optionally have been sealed or passivated by contact with chromate-containing or other suitable aqueous liquid compositions, before being painted. An alternative object is to permit replacing chromate passivating treatments with other treatments less injurious to the environment, while still retaining the performance quality now achieved by phosphating, chromate passivating, and electrophoretic painting.

GENERAL PRINCIPLES OF DESCRIPTION

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts of", and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counterions to produce electrical neutrality for the composition as a whole (any counterions thus implicitly specified should preferably be selected from among other constituents explicitly specified in ionic form, to the extent possible; otherwise such counterions may be freely selected, except for avoiding counterions that act adversely to the stated objects of the invention); the term "metal surface" and its grammatical variants is to be understood as including not only bare metal surfaces but also such surfaces as modified by spontaneous reaction with the natural ambient atmosphere and/or by any prior treatment described herein; and the term "mole" and its variations may be applied to elemental, ionic, and any other chemical species defined by number and type of atoms present, as well as to compounds with well defined molecules.

SUMMARY OF THE INVENTION

It has been discovered that mapping by electrophoretic, especially cathodic, paints can be reduced or avoided by properly controlling the process conditions, replacing a passivating composition that contains at least 0.05% of chromium with an alternative composition that contains not more than 0.04% of chromium, and/or introducing an additional treatment with a suitable aqueous liquid composition that contains not more than 0.04% of chromium before any passivating treatment composition containing at least 0.05% of chromium is applied.

More specifically, mapping may be reduced by assuring that the surface of the substrate never is allowed to become dry at any point between the completion of phosphate conversion coating and the beginning of electrophoretic painting, preferably by arranging for the substrate surface to be supplied with water, preferably water purified by distillation, deionization with ion-exchange resins or reverse osmosis, or otherwise (such purified water hereinafter being usually denoted for brevity as "DI [for "deionized"] water", no matter how actually purified), at any point between these two process stages where it otherwise might become dry. While effective, this method is often impractical to introduce into existing process lines, which usually do not have facilities in place for supplying purified water at locations between the standard operating stages. Also, the use of as much water as would be required by this method for many commercial operations would result in substantially faster unwanted dilution of the other treatment compositions, requiring a higher and correspondingly more expensive use of replenisher compositions to maintain the desired chemical effects in process stages that can not be effectively performed by contact with water alone.

Accordingly, it is normally preferred for this invention to utilize aqueous liquid treatment compositions that comprise, preferably consist essentially of, or more preferably consist of, water and at least one of the following components: (A) a water soluble and/or water dispersible polymer with a weight average molecular weight of at least 500, preferably polymer(s) of vinyl phenol(s) with partial ring substitution of hydrogen by alkylaminomethyl moieties as taught generally in at least one of the following U.S. Patents, the complete specifications of which, except to the extent that they may be inconsistent with any explicit statement herein, are hereby incorporated herein by reference: U.S. Pat. Nos. 4,376,000, 4,433,015, 4,457,790, 4,517,028, 4,963,596, 5,063,089, 5,116,912, and 5,298,289 (these polymers being hereinafter often abbreviated as "ASPVP" for "alkylaminomethyl substituted poly{vinyl phenol}"); (B) fluorometallic acids and anions thereof, the molecules of which consist of (i) at least one atom of boron, silicon, zirconium, iron, aluminum, or titanium, (ii) at least four fluorine atoms, and, optionally, (iii) one or more atoms of oxygen, hydrogen, or both; (C) zirconium salts of ethylenediamine tetraacetic acid; and (D) alkali metal and ammonium salts of zirconium hydroxycarboxylates and zirconium hydroxycarbonates (alternatively called alkali metal and ammonium zirconyl carboxylates and carbonates). These aqueous liquid treatment compositions may entirely replace any passivating compositions formerly used that contained as much as 0.05% of chromium, or they may be used after the phosphate conversion coating but before treatment with a conventional chromium containing passivating composition, taking care to prevent drying of the treated surfaces between use of the aqueous liquid treatment composition and contact of the surface with any chromium containing passivating composition.

DESCRIPTION OF PREFERRED EMBODIMENTS

For a variety of reasons, it is preferred that aqueous liquid treatment compositions according to the invention as defined above should be substantially free from certain ingredients used in compositions for similar purposes in the prior art. Specifically, it is increasingly preferred in the order given, independently for each preferably minimized component listed below, that these compositions, when directly contacted with metal in a process according to this invention, contain no more than 1.0, 0.35, 0.10, 0.08, 0.06, 0.04, 0.03, 0.02, 0.01, 0.007, 0.003, 0.001, 0.0007, 0.004, or 0.0002, percent of each of cyanide and nitrite ions, and, unless its use is required for the particular use to be made of substrates treated according to the invention, chromium should also be minimized.

Furthermore, in a process according to the invention that includes other steps than treating a metal surface with a composition as described above, it is normally preferred that none of these other steps include contacting the surfaces with any composition that contains more than, with increasing preference in the order given, 1.0, 0.35, 0.10, 0.08, 0.04, 0.02, 0.01, 0.003, 0.001, or 0.0002% of hexavalent chromium, except that a final protective coating system including an organic binder, more particularly those including a primer coat, may include hexavalent chromium as a constituent. Any such hexavalent chromium in the protective coating is generally adequately confined by the organic binder, so as to avoid adverse environmental impact.

A working ASPVP composition for use in a process according to this invention preferably comprises, more preferably consists essentially of, or still more preferably consists of, water, water soluble polymer and/or acid salts thereof as described in column 3 lines 5 through 64 of U.S. Pat. No. 4,443,015, and, optionally, one or more fluorometallic acids or anions thereof as defined above. The total amount of ASPVP and acid salts thereof dissolved in the aqueous working composition preferably is, with increasing preference in the order given, at least 0.004, 0.008, 0.016, 0.030, 0.040, 0.050, 0.055, 0.060, 0.065, 0.070, 0.073, 0.076, 0.079, 0.081, 0.082, 0.083, or 0.084%, and independently preferably is, with increasing preference in the order given, not more than 10, 5, 3, 2, 1, 0.9, 0.8, 0.7, 0.6, 0.5, 0.4, 0.30, 0.25, 0.22, 0.20, 0.18, 0.16, 0.14, 0.12, 0.10, or 0.09%. (The preferred upper limits as noted above are preferred primarily for economic reasons. No adverse effect on quality is known from even higher concentrations, but such concentrations also do not further improve quality and result in more waste. In contrast to this, concentrations lower than those noted above as preferred may result in less effective corrosion protection.)

The molar ratio of nitrogen atoms to aromatic rings in an ASPVP working composition for use in a process according to this invention for replacing or preceding a chromium containing passivating treatment preferably is, with increasing preference in the order given, not less than 0.10, 0.20, 0.30, 0.40, 0.50, 0.60, 0.70, 0.80, 0.85, 0.90, 0.93, 0.95, or 0.96 and independently preferably is, with increasing preference in the order given, not more than 2.0, 1.5, 1.4, 1.3, 1.2, 1.15, 1.10, 1.05, or 1.00. Independently, the nitrogen atoms in the water soluble polymer and/or salts thereof in the ASPVP working composition for use in a process according to this invention for replacing or preceding a chromium containing passivating treatment preferably is chemically bonded to the aromatic rings in said polymer via a methylene moiety and is chemically bonded to two other organic moieties, each of which independently is preferably selected from the group consisting of alkyl and hydroxyalkyl moieties. Independently, these alkyl and hydroxyalkyl moieties preferably have not more than, with increasing preference in the order given, 10, 6, 5, 4, 3, or 2 carbon atoms each. Also independently, the two alkyl or substituted alkyl moieties attached to each nitrogen atom preferably include at least one, more preferably exactly one, hydroxyalkyl moiety containing a single hydroxyl moiety.

The pH of an ASPVP working composition for use in a process according to this invention for replacing or preceding a chromium containing passivating treatment preferably is, with increasing preference in the order given, at least 0.5, 1.5, 2.5, 3.5, 4.0, 4.3, 4.5, 4.7, 4.8, 4.9, or 5.0 and independently preferably is, with increasing preference in the order given, not more than 12, 11, 10, 9, 8.5, 8.0, 7.7, 7.4, 7.2, 7.0, 6.8, 6.6, 6.4, 6.3, 6.2, 6.1, or 6.0. Normally, achieving the most preferred pH values as thus defined will require the presence in the composition of at least some acid salt in addition to neutral polymer. The acid part of such acid salt may be selected as taught in the U.S. Patents incorporated herein by reference above. It is particularly preferred that, with increasing preference in the order given, at least 0.002, 0.004, 0.006, 0.008, 0.010, 0.012, 0.014, 0.016, or 0.017 of the total ASPVP working composition according to the invention be constituted by fluotitanic acid and/or acid salts thereof with the alkylaminomethyl ring substituted polymers of vinyl phenol already described. Higher concentrations than these of fluotitanic acid are not deleterious but are more expensive than other acids such as phosphoric and nitric that appear to give equally good performance when substituted for any higher amounts of fluotitanic acid that might be needed to achieve the most preferable pH values for the compositions.

The time of contact between a phosphate coated metal surface and an aqueous liquid treatment composition according to this invention preferably is, with increasing preference in the order given, not less than 2, 4, 8, 12, 15, 18, 21, 24, 26, 28, or 30 seconds and independently preferably is, with increasing preference in the order given, not more than 600, 300, 200, 100, 75, 60, 50, 45, 40, 35, or 32 seconds. (The preferred upper limits are preferred primarily for economy of operation; it is not expected that long contact times will have any deleterious effect on the quality of the protection achieved in a process according to the invention. Shorter contact times than those preferred, on the other hand, may lead to inadequate protection.) The temperature of the treatment composition used according to the invention preferably is, with increasing preference in the order given, not less than 10°, 15°, or 20° C. and independently preferably is, with increasing preference in the order given, not more than 80°, 70°, 60°, 50°, 45°, 40°, 35°, or 30° C.

Although ASPVP containing compositions are most preferred, a wide variety of other compositions may be used. Among these other types of somewhat less preferred but suitable compositions are:

Compositions comprising, preferably consisting essentially of, or more preferably consisting of water, soluble zirconium compounds and a water soluble and/or spontaneously water dispersible polymer as described in U.S. Pat. No. 3,912,548 of Oct. 14, 1975 to Faigen, the following portions of which, except to the extent that they may be contrary to any explicit statement herein, are hereby incorporated herein by reference: Column 2 line 7 through column 4 line 13; column 5 lines 39 through 65; column 6 lines 5 through 33; Example 1; column 9, last paragraph; and the compositions in Tables 9 and 10, together with the sentences that run from line 23 through line 27 and from lines 56–60 of column 16.

Compositions comprising, preferably consisting essentially of, or more preferably consisting of (i) water, (ii) from 0.2 to 8 g/L of at least one acid selected from the group consisting of $H_2ZrF_6$, $H_2TiF_6$, and $H_2SiF_6$, and (iii) from 0.5 to 10 g/L of polymers selected from the group consisting of polyacrylic acid and esters thereof, as described in U.S. Pat. No. 4,191,596 of Mar. 4, 1980 to Dollman et al., the following portions of which, except to the extent that they may be contrary to any explicit statement herein, are hereby incorporated herein by reference: column 2 lines 14 to 26; column 2 line 47 through column 3 line 55; and the compositions given in Tables 1 and 2.

Compositions comprising, preferably consisting essentially of, or more preferably consisting of (i) water, (ii) from 0.03 to 0.9 g/L of a water soluble first polymer having a plurality of carboxyl functional groups, and (iii) from 0.01 to 0.6 g/L of a water soluble second polymer having a plurality of hydroxyl groups, the ratio of moles of carboxyl groups to moles of hydroxyl functional groups provided by these water soluble polymers being from 0.3:1.0 to 3.5:1.0, and, optionally but preferably, (iv) from 0.7 to 3.0 g/L in total of at least one of (iv.1) zirconium and titanium salts of ethylenediamine tetraacetic acid, (iv.2) alkali metal and ammonium salts of zirconium and titanium hydroxycarboxylates and zirconium and titanium hydroxycarbonates, and (iv.3) fluorometallic acids and anions thereof, the molecues of which consist of (iv.3.i) at least one atom of zirconium or titanium, (iv.3.ii) six fluorine atoms, and, optionally, (iv.3.iii) one or more atoms of hydrogen. These compositions and equivalent ones with only a single difunctional type of polymer are described in more detail in International Patent Application PCT/US93/11627, the specification of which was published as WO94/12570 on 9 Jun. 1994.

For any process steps other than contact with a treatment composition according to the invention that may be a part of a process according to this invention, the preferred conditions are generally those known per se for the same or a similar process step in the prior art.

The invention may be further appreciated by consideration of the following non-limiting working examples and comparison examples.

EXAMPLES AND COMPARISON EXAMPLE GROUP 1

A commercial automobile manufacturing plant, in which automobile bodies are subjected successively to phosphating with BONDERITE® 958[1] zinc-manganese-nickel phosphating solution, rinsing, passivating with PARCOLENE® 60[1] mixed hexavalent and trivalent chromium containing liquid composition, rinsing, and painting with Cathogard™ 200[2] cathodically applied paint, normally operates successfully with no mapping problem. However, on a particular day observed by one applicant inventor here, every automobile hood processed for several hours was observed to have in the paint finish a narrow line of coating thinner than the surrounding coating, indicative of locally lower electrical conductivity, even though all specified conditions of the processing steps were being controlled within their customary tolerance limits which do not result in mapping on most days. The line defect in the paint observed on the day in question matched in location a line observed around the air scoop cutouts on the hood during the drying pattern after rinsing with DI water following the phosphating step. (The line speed and distance between process stages in this manufacturing plant are such that complete drying of at least part of the surfaces normally occurs between the time of entry to the passivating composition spray zone and the last preceding water rinse before such entry and also occurs again between emergence from the passivating composition spray zone and a DI water spray rinse zone located 30 meters ahead of the entry to the paint coating tank. Drying does not normally occur between this last mentioned rinse and the entry to the paint coating tank.)

[1]Commercially available from the Parker Amchem Division of Henkel Corp., Madison Heights, Mich.

[2]Commercially available from BASF Corporation.

The following improvised measures were attempted to correct this mapping problem, with the results indicated:

1.1. The hoods were flooded with a large mass of DI water prior to entering the DI water spray rinse zone located 10 meters ahead of the entry to the paint coating tank. This rewetting did not reduce the mapping pattern.

1.2. The area of the hoods on which the mapping defect was occurring was wiped with a solvent saturated cloth at about the same point in the production line as noted for item 1.1. Again, this did not reduce the mapping problem.

1.3. DI water was applied as needed at every point along the production line between exit from the phosphating immersion tank to entry into the paint immersion tank, in order to assure that the surface never became dry during this time. This measure completely eliminated the mapping problem, even though autobodies otherwise identically processed both before and after the bodies on which this constant wetting was maintained showed the same mapping line defect problem as before.

1.4. An ASPVP containing composition containing the following ingredients in addition to deionized water was prepared: (i) 0.085% of a high molecular weight organic material produced by reacting a homopolymer of 4-vinyl phenol having an average molecular weight of about 5000 with sufficient amounts of methyl ethanol amine and formaldehyde to substitute an average of 0.97 N,N-methyl-2-hydroxyethylaminomethyl moieties per aromatic ring for hydrogen atoms on the aromatic rings in the homopolymer starting material;[3] (ii) 0.029% of orthophosphoric acid; (iii) 0.0047% of sodium hydroxide; and (iv) 0.018% of fluotitanic acid. This ASPVP containing composition was applied to the autobodies just after they had passed through the DI water spray rinse zone located 10 meters ahead of the entry to the paint coating tank. This rewetting did not reduce the mapping pattern.

[3]Such a polymer may be prepared according to the teachings of the U.S. Patents incorporated by reference into this specification.

1.5. The same ASPVP composition as described in item 1.4 was applied to the autobodies just prior to the process zone where the PARCOLENE® 60 spray coating was applied. The mapping problem was eliminated, even though other autobodies processed immediately before and after this test showed the mapping pattern.

1.6. This was the same as item 1.5, except that the PARCOLENE® 60 spray coating was discontinued. The mapping problem was again eliminated.

EXAMPLE AND COMPARISON EXAMPLE GROUP 2

For this group, panels of electrogalvanized iron-zinc alloy, which is known to be exceptionally sensitive to mapping problems with cathodically electrodeposited paint, were used. Many such panels were coated in a laboratory process unit by the steps shown in Table 1 below, except that only one of the three possible passivating steps noted in the Table was performed on any one test panel, and on some of the test panels, no passivating treatment at all was applied.

Panels with each type of laboratory-applied passivating treatment shown in Table 1 and other panels with no passivating treatment were then attached to actual automobile bodies in such a manner that the panel had the same angle to the ground, specifically nearly horizontal, as the hood areas on these autobodies that were known from prior experience to be most susceptible to developing a mapping defect.

The test panels with laboratory applied passivating treatments and some of the test panels without laboratory applied passivating treatments were attached to the autobodies just after the latter had emerged from the sprayed passivating treatment area of the normal production operation, while other test panels with no laboratory passivating treatment were attached to the autobodies at an earlier point in the process sequence, just before the normal plant passivating operation, so that they were exposed to the same plant applied processing treatment as the autobodies to which they were attached.

All these types of attached panels were then subjected to all of the subsequent treatments applied to the autobodies after the point in the process line at which they were attached to the autobodies, including eventual cathodically applied painting, during a time period when normal production operations were resulting in no evident mapping defect on most of the autobodies finished. (These autobodies were made of a substrate metal less susceptible to mapping defects than the electrogalvanized zinc-iron alloy used for the test panels.) As a final variation in this group, for some of the hoods, the passivating treatment spray was turned off, so that there was no passivating treatment at all. The passivating treatment composition sprayed by the normal plant equipment during this test was substantially the same as is described for "Pas. #2" in Table 1. The results of these tests are shown in Table 2 below.

TABLE 1

| Name for Process Stage | Description of Treatment Fluid for This Stage | Contact Method | Contact Time, Seconds | Contact Temperature, °C. |
|---|---|---|---|---|
| Clean | A solution of 15 g/L of PARCO ® Cleaner 1501 in water | I | 120 | 52 |
| Rinse | Warm water | S | 30 | 38 |
| Activate | A solution of 4.0 g/L of FIXODINE ® ZN conditioner concentrate in water, pH 9 | S | 45 | 38 |
| Phosphate | BONDERITE ® 958 Phosphating Bath with 0.8 Point of Free Acid, 24.5 Points of Total Acid, and 2.0 Points of Accelerator | I | 120 | 52 |
| Rinse | Cold water | S | 30 | 20–25 |
| Pas. #1 | PARCOLENE ® 60A Working Composition at 3.5 "Points" | S | 30 | 20–25 |
| Pas. #2 | PARCOLENE ® 76 Working Composition at 8.0 "Points" | S | 30 | 20–25 |
| Pas. #3 | The ASPVP composition as described for Item 1.4 in Group 1 above | S | 30 | 20–25 |

TABLE 1-continued

| Name for Process Stage | Description of Treatment Fluid for This Stage | Contact Method | Contact Time, Seconds | Contact Temperature, °C. |
|---|---|---|---|---|
| Rinse | DI water | S | 30 | 20–25 |
| Dry | Hot air | — | As needed | |

Notes for Table 1

All of the ingredients necessary to make the working compositions in the table that are identified by one of the trademarks PARCO ®, FIXODINE ®, BONDERITE ®, and PARCOLENE ® are commercially available from the Parker Amchem Div. of Henkel Corp., Madison Heights, Michigan, along with directions and apparatus for preparing working compositions and performing the tests used to characterize these working compositions by "points" as used in the table above. "Pas." is an abbreviation for "Passivating Composition". The active ingredient in Passivating Composition #2 is trivalent chromium. Use of Passivating Composition #3 is according to the present invention, while use of Passivating Compositions #1 and 2 is not. In the column headed "Contact Method", "S" means spraying and "I" means immersion.

TABLE 2

| Nature of Sample | Degree of Mapping Observed |
|---|---|
| Hoods, normal production | None |
| Panels, phosphated in lab, passivated in plant only | Slight |
| Panels, phosphated and Pas. #1 in lab | Slight |
| Panels, phosphated and Pas. #2 in lab | Moderate |
| Panels, phosphated and Pas. #3 in lab | None; best overall appearance |
| Hoods, no passivating treatment | None |

EXAMPLES GROUP 3

The following compositions, with alternative solutes not including any ASPVP, are used in the same general manner as is described in Examples and Comparison Examples Groups 1 and 2 above for the ASPVP containing treatment compositions there described, in order to reduce or prevent mapping:

3.1: A composition containing ammonium zirconyl carbonate in an amount stoichiometrically equivalent to 2.0 g/L of $ZrO_2$ and 2.8 g/L of polyacrylic acid[4], with the balance water.

[4]From a latex commercially supplied by Rohm & Haas under the designation ACUMER™ 1510.

3.2: A composition with a pH of 2.1, containing 4.11 g/L of polyacrylic acid[4] and 1.23 g/L of fluozirconic acid, with the balance water.

[4]From a latex commercially supplied by Rohm & Haas under the designation ACUMER™ 1510.

3.3: A composition with a pH of 2.1, containing 4.11 g/L of polyacrylic acid[4] and 1.94 g/L of fluotitanic acid, with the balance water.

[4]From a latex commercially supplied by Rohm & Haas under the designation ACUMER™ 1510.

3.4: A composition with a pH of 2.2, containing 2.05 g/L of polyacrylic acid[4] and 0.97 g/L of fluotitanic acid, with the balance water.

[4]From a latex commercially supplied by Rohm & Haas under the designation ACUMER™ 1510.

3.5: A composition with a pH of 2.1, containing 4.11 g/L of polyacrylic acid[4] and 0.85 g/L of fluosilicic acid, with the balance water.

[4]From a latex commercially supplied by Rohm & Haas under the designation ACUMER™ 1510.

3.6: A composition containing 2% by volume of a first subcomposition, which consists of 1.46% polyvinyl alcohol[5], 2.28% of polyacrylic acid[4], 0.05% of ammonium bifluoride, and 96.21% of water; 2% by volume of a second subcomposition, which consists of 7.4% of fluozirconic acid, 0.3% of hydrofluoric acid, and 92.3% water; and a balance of water.

[4]From a latex commercially supplied by Rohm & Haas under the designation ACUMER™ 1510.

[5]Commercially supplied by Air Products & Chemicals, Inc. under the designation AIRVOL™ 125

3.7: A composition that is like 3.6, except that ammonium zirconyl carbonate is substituted for the fluozirconic acid in composition 3.6, in an amount so as to result in the same concentration of zirconium atoms in the composition as in Composition 3.6.

The invention claimed is:

1. A process for reducing or avoiding surface irregularities in electrophoretic painting of phosphated metal surfaces, said process consisting essentially of the successive steps of:

(I) contacting said metal surface with an aqueous liquid phosphate conversion coating composition;

(II) while said metal surface is still wet with the conversion coating composition continuously contacting said wetted metal surface after performing step (I) with an aqueous liquid treatment composition comprising water, a trace amount of not more than a total of 0.0002 wt. % of hexavalent and trivalent chromium, and at least one component selected from the group consisting of: (II.1) a water soluble polymer, a water dispersible polymer or both a water soluble polymer and a water dispersible polymer wherein each of the polymers has a weight average molecular weight of at least 500; (II.2) fluorometallic acids and anions thereof consisting of (II.2.i) at least one atom of boron, silicon, zirconium, iron, aluminum, and titanium, (II.2.ii) at least four fluorine atoms, and, optionally, (II.2.iii) one or more atoms of oxygen, hydrogen, or both; (II.3) zirconium salts of ethylenediamine tetraacetic acid; and (II.4) alkali metal and ammonium salts of zirconium hydroxycarboxylates or zirconium hydroxycarbonates; and (III) after completing the step (II), while said metal surface is still wet with the aqueous liquid treatment composition, applying to said wetted metal surface an electrophoretic paint protective outer coating.

2. A process according to claim 1, wherein said electrophoretic paint is cathodically electrodeposited; in step (II), the metal surface is contacted with the aqueous liquid treatment composition comprising water, not more than a total of 0.0002 wt. % of hexavalent and trivalent chromium, and a total of at least about 0.004 wt. % of a material selected from the group consisting of alkylaminomethyl substituted polymers of vinyl phenol and acid salts of alkylaminomethyl substituted polymers of vinyl phenol; and the process optionally also consists essentially of a step (II'), performed after step (II) but before step (III), of contacting the metal surface with a phosphate conversion coating passivating composition comprising a total of 0.0002 wt. % of material selected from the group consisting of trivalent chromium, hexavalent chromium and mixtures thereof.

3. A process according to claim 2, wherein the phosphate conversion coating composition is a zinc phosphating composition.

4. The process according to claim 3, wherein the phosphate conversion coating composition contains manganese and said manganese is incorporated into said protective coating.

5. A process according to claim 4, wherein the phosphate conversion coating composition contains further nickel and said nickel is incorporated into the conversion coating formed.

6. A process according to claim 5, wherein said aqueous liquid treatment composition used in step (II) is a chromium free aqueous liquid composition that has a pH in the range from about 4.0 to about 9 and comprises a total of from about 0.050 wt % to about 0.5 wt % of alkylaminomethyl substituted polymers of vinyl phenol and acid salts thereof.

7. A process according to claim 6, wherein said aqueous liquid treatment composition used in step (II) has a pH in the range from 4.5 to 7.0 and contains a total of from about 0.060 wt % to about 0.18 wt % of alkylaminomethyl substituted polymers of vinyl phenol and acid salts thereof in which the nitrogen atoms in the alkylaminomethyl groups are chemically bonded to aromatic rings in said polymer through methylene groups and are also chemically bonded to two other organic moieties selected from the group consisting of alkyl and hydroxyalkyl moieties with no more than 4 carbon atoms each, the molar ratio of nitrogen atoms to aromatic rings in the substituted polymers of vinyl phenol being from about 0.5 to about 1.5.

8. A process according to claim 7, wherein the aqueous liquid treatment composition used in step (II) has a pH in the range from about 4.7 to about 6.4 and the nitrogen atoms in the alkylaminomethylene groups are also bonded to two organic moieties selected from the group consisting of alkyl and hydroxyalkyl moieties with no more than 2 carbon atoms and one hydroxyl moiety each, the molar ratio of nitrogen atoms to aromatic rings in the substituted polymers of vinyl phenol being from about 0.70 to about 1.3.

9. A process according to claim 8, wherein said aqueous composition used in step (II) has a pH in the range from about 5.0 to about 6.0 and comprises from about 0.076% to about 0.12% of N,N-methyl-2-aminoethylaminomethyl substituted polymers of vinyl phenol, and wherein said metal surface after performing step I is contacted with said aqueous composition for a time from about 24 to about 45 seconds, said aqueous composition having a temperature during its contact with the metal surface after performing step I in the range from about 20° C. to about 30° C., and the molar ratio of nitrogen atoms to aromatic rings in the substituted polymers of vinyl phenol is from about 0.90 to about 1.10.

10. A process according to claim 1, wherein in step (II) the metal surface is contacted with the aqueous liquid treatment composition consisting essentially of (i) water, (ii) not more than 0.0002 wt. % of chromium, (iii) from about 0.1 to about 3.5 g/L, measured as its stoichiometric equivalent as zirconium dioxide, of a dissolved zirconium compound selected from the group consisting of alkali metal fluozirconates, ammonium fluozirconates, alkali metal zirconium hydroxycarboxylates, ammonium zirconium hydroxycarboxylates, alkali metal zirconium hydroxycarbonates, and ammonium zirconium hydroxycarbonates, and (iv) from about 0.1 to about 5.0 g/L in total of dissolved material selected from the group consisting of polyacrylic acid, polyacrylic acid esters, polyacrylic acid salts, poly{vinyl alcohol}, hydroxyethyl ethers of cellulose, copolymers of ethylene and maleic anhydride, poly{vinyl pyrrolidone}, and poly{vinyl methyl ether}; and optionally also comprising a step (II'), performed after step (II) but before step (III), of contacting the metal surface with a phosphate conversion coating passivating composition comprising 0.0002 wt. % of chromium.

11. A process according to claim 10, wherein, in the aqueous liquid treatment composition used in step (II), component (iii) is ammonium zirconyl carbonate, component (iv) is selected from the group consisting of polyacrylic acid, esters of polyacrylic acid and salts of polyacrylic acid, and the amount of component (iv) is from about 1.0 to about 2.0 times the amount of dissolved zirconium compound in the aqueous liquid treatment composition measured as its stochiometric equivalent as zirconium dioxide.

12. A process according to claim 1, wherein said aqueous liquid treatment composition used in step (II) consists essentially of (i) water, (ii) not more than a total of 0.0002 wt. % of hexavalent and trivalent chromium, (iii) from about 0.2 to about 8 g/L of at least one acid selected from the group consisting of $H_2ZrF_6$, and $H_2SiF_6$, and (iv) from about 0.5 to about 10 g/L of polymers selected from the group consisting of polyacrylic acid and esters thereof; said process optionally also comprising a step (II'), performed after step (ii) but before step (III), of contacting said metal surface with a phosphate conversion coating passivating composition comprising total of 0.0002 wt. % of a material selected from the group consisting of trivalent chromium, hexavalent chromium and mixtures thereof.

13. A process according to claim 12, wherein, in the aqueous liquid treatment composition used in step (II), the content of component (iii) is from about 1.5 to about 6.0 g/L and the content of component (iv) is from about 0.75 to about 4.0 g/L.

14. A process according to claim 1, wherein in step (II)(A) said metal surface is contacted with the aqueous liquid treatment composition consisting essentially of (i) water, (ii) not more than 0.0002 wt. % of chromium, (iii) from about 0.03 to about 0.9 g/L of a water soluble first polymer having a plurality of carboxyl functional groups, and (iv) from about 0.01 to about 0.6 g/L of a water soluble second polymer having a plurality of hydroxyl groups, the ratio of moles of carboxyl groups to moles of hydroxyl functional groups provided by these water soluble polymers being from 0.3:1.0 to 3.5:1.0; said process optionally also comprising a step (II'), performed after step (II) but before step (III), of contacting the metal surface with a phosphate conversion coating passivating composition comprising a total of 0.0002 wt. % of a material selected from the group consisting of trivalent chromium, hexavalent chromium, and mixtures thereof.

15. A process according to claim 14, wherein the aqueous liquid treatment composition used in step (II) also comprises (v) from 0.7 to 3.0 g/L in total of at least one of (v.1) zirconium or titanium salts of ethylenediamine tetraacetic acid, (v.2) a material selected from the group consisting of alkali metal salts of zirconium hydroxycarboxylates, ammonium salts of zirconium hydroxycarboxylates, alkali salts of titanium hydroxycarboxylates, ammonium salts of titanium hydroxycarboxylates, zirconium hydroxycarbonates and titanium hydroxycarbonates, alkali metal and ammonium salts of zirconium, and titanium hydroxycarboxylates and zirconium and titanium hydroxycarbonates, and (v.3) fluorometallic acids and anions thereof, the molecules of which consist of (v.3.i) at least one atom of zirconium or titanium, (v.3.ii) six fluorine atoms, and, optionally, (v.3.iii) one or more atoms of hydrogen.

16. A process according to claim 2, wherein the aqueous liquid treatment composition used in step (II) is a chromium free aqueous liquid composition that has a pH in the range from about 4.0 to about 9 and comprises a total of from about 0.050 to about 0.5 wt % of alkylaminomethyl substituted polymers of vinyl phenol and acid salts thereof.

17. A process according to claim 16, wherein the aqueous liquid treatment composition used in step (II) has a pH in the range from 4.5 to 7.0 and contains a total of from about 0.060 to about 0.18 wt % of alkylaminomethyl substituted polymers of vinyl phenol and acid salts thereof in which the nitrogen atoms in the alkylaminomethyl groups are chemically bonded to aromatic rings in said polymer through methylene groups and are also chemically bonded to two other organic moieties selected from the group consisting of alkyl and hydroxyalkyl moieties with no more than 4 carbon atoms each, the molar ratio of nitrogen atoms to aromatic rings in the substituted polymers of vinyl phenol being from about 0.5 to about 1.5.

18. A process according to claim 3, wherein the aqueous liquid treatment composition used in step (II) is a chromium free aqueous liquid composition that has a pH in the range from about 4.0 to about 9 and comprises a total of from about 0.050 to about 0.5 wt % of alkylaminomethyl substituted polymers of vinyl phenol and acid salts thereof.

19. A process according to claim 18, wherein the aqueous liquid treatment composition used in step (II) has a pH in the range from 4.5 to 7.0 and contains a total of from about 0.060 to about 0.18 wt % of alkylaminomethyl substituted polymers of vinyl phenol and acid salts thereof in which the nitrogen atoms in the alkylaminomethyl groups are chemically bonded to aromatic rings in said polymer through methylene groups and are also chemically bonded to two other organic moieties selected from the group consisting of alkyl and hydroxyalkyl moieties with no more than 4 carbon atoms each, the molar ratio of nitrogen atoms to aromatic rings in the substituted polymers of vinyl phenol being from about 0.5 to about 1.5.

20. A process according to claim 19, wherein the aqueous composition used in step (II) has a pH in the range from about 5.0 to about 6.0 and comprises from about 0.076 to about 0.12% of N,N-methyl-2-aminoethylaminomethyl substituted polymers of vinyl phenol, the metal surface after performing step I is contacted with said aqueous liquid treatment composition for a time from about 24 to about 45 seconds, said aqueous liquid having a temperature during its contact with the metal surface after step I in the range from about 20° to about 30° C., and the molar ratio of nitrogen atoms to aromatic rings in the substituted polymers of vinyl phenol is from about 0.90 to about 1.10.

* * * * *